US006394751B1

(12) United States Patent
Daudel et al.

(10) Patent No.: US 6,394,751 B1
(45) Date of Patent: May 28, 2002

(54) RADIAL COMPRESSOR WITH WALL SLITS

(75) Inventors: Helmut Daudel, Schorndorf; Joseph Spurk, Bad König, both of (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/563,822

(22) Filed: May 3, 2000

(30) Foreign Application Priority Data

May 5, 1999 (DE) ..... 199 20 524

(51) Int. Cl.[7] ..... F04D 29/54
(52) U.S. Cl. ..... 415/208.3; 415/914
(58) Field of Search ..... 415/203, 206, 415/914

(56) References Cited

U.S. PATENT DOCUMENTS 4,212,585 A 7/1980 Swarden et al. ..... 415/53 R
4,781,530 A * 11/1988 Lauterbach et al. ..... 415/914
5,137,419 A * 8/1992 Waterman ..... 415/914
5,707,206 A * 1/1998 Goto et al. ..... 415/914
5,762,470 A * 6/1998 Gelmrfov et al. ..... 415/914
6,164,911 A * 12/2000 LeBlanc et al. ..... 415/914

FOREIGN PATENT DOCUMENTS

DE 40 27 174 A1 8/1990
EP 0 348 674 5/1989

* cited by examiner

*Primary Examiner*—John Kwon
(74) *Attorney, Agent, or Firm*—Klaus J. Bach

(57) ABSTRACT

The invention relates to a radial compressor for producing a compressed gas flow, having a casing, an impeller which is arranged therein has a hub which carries blades. A ring is arranged in the flow duct concentrically with the hub, and is accommodated in a recess in the inner surface of the casing. The ring has wall slits on its inner surface. An annular gap is provided between that end face of the ring which is directed downstream and an end face of the recess which corresponds thereto and is directed upstream.

6 Claims, 2 Drawing Sheets

RADIAL COMPRESSOR WITH WALL SLITS

The invention relates to a radial compressor, and more specifically, a radial compressor with wall slits.

BACKGROUND

Radial compressors are used in many fields of technology for producing a compressed gas flow. Thus, for example in many internal combustion engines, in particular in larger diesel engines, the charge air supplied is compressed by means of a radial compressor in order to increase the output. This charge-air compression is often designated as "supercharging". The radial compressor is often driven by an exhaust-gas turbine and forms with the latter a so-called exhaust-gas turbocharger.

In radial compressors there is the problem that they assume an unsteady operating state if the volumetric flow falls below a certain value. In this connection, the term "surging" of the radial compressor is also used. In this state, the radial compressor builds up only an inadequate pressure, a factor which, in supercharged internal combustion engines for example, becomes apparent as a so-called "turbohole" at low speeds. In addition, pronounced unsteady flows occur which mechanically load the components of the radial compressor to a considerable degree and can reduce the service life of the radial compressor.

Various measures have therefore been developed, the aim of these measures being to reduce the surge limit, i.e. the limit between the steady and the unsteady range, towards lower volumetric flows. In supercharged internal combustion engines, this increases their output in the low speed range and leads to reduced pollutant emissions.

One of these measures is known as so-called wall treatment and includes the making of wall slits in the casing wall adjoining the flow duct, as described in U.S. Pat. No. 4,212,585 establishing the generic type. The radial compressor disclosed in this publication has a casing in which a hub provided with moving blades is arranged. An inner surface of the casing and the surface of the hub form the boundary surfaces of a flow duct. Arranged therein concentrically to the hub is a ring which is accommodated in a recess in the inner surface of the casing. That end face of the ring which points downstream abuts so snugly against a corresponding end face of the recess that the flow duct has no step on the casing side. At the height of the moving-blade ends directed upstream, wall slits are arranged in the inner wall of the ring, and these wall slits produce the desired displacement of the surge limit. It is assumed that the wall slits counteract the formation of recirculation vertices which form in the front impeller region and are considered to be the reason for the start of the "surging".

Laid-open specification EP 0 348 674 A1 discloses a device which is intended for extending the characteristic diagram of a radial compressor in the direction of small rates of flow in the inlet region of the impeller of the compressor and contains a recess which runs in the circumferential direction of a compressor inlet duct and extends upstream from the inlet opening of the impeller, and in which a stabilizing ring is integrated, the stabilizing ring being arranged in front of the impeller and outside the main flow duct and carrying a number of blades on its outer circumference, the blades in turn being anchored to the inner contour of the recess.

Laid-open specification DE 40 27 174 A1 describes a radial compressor having a device for stabilizing the characteristics, this device having a circulation space for the purpose of balancing the pressure between compressor impeller and an inlet region upstream of the impeller. Provided in the inlet region is an intake ring with which the flow is to be influenced there in such a way as to stabilize the characteristics and minimize the losses and which can be modified in a customized manner. The circulation space is defined radially on the inside by a contour ring, which extends axially between an upstream intake groove connected to the inlet region and a contour groove which opens into the main flow in the region of the impeller contour.

The object of the invention is to provide a radial compressor of the type mentioned at the beginning in which a reduction in the surge limit is achieved by suitable measures.

SUMMARY

A radial compressor according to this invention has a casing having a recess formed in an inner surface. An impeller is arranged in the casing for rotation about a rotational axis. The impeller has a hub carrying blades, with the hub and inner surface of the casing defining a flow duct. A ring is received in the recess formed in the inner surface of the casing and arranged concentrically with the hub of the impeller. The ring has slits in an inner surface in a region spaced axially from a downstream facing end face of the ring. The downstream facing end face of the ring is in spaced axial relation to an upstream facing wall of the recess, defining an annular gap therebetween. The blades of the impeller have upstream facing ends that lie axially between opposed axial ends of the wall slits, preferably at a distance from the two opposed axial ends of the wall slits that is greater than the wall-slit width. It has been found that, in radial compressors designed in such a way and having a gap, the surge limit is once again clearly displaced towards lower volumetric flows. Especially good results can be obtained if, to create a pressure balance, the gap is connected to the upstream space in front of the ring via passages which are independent of the flow duct.

In a further embodiment, the extent or width of the annular gap in the axial direction is 1 to 5 per cent of the diameter of the impeller. In a further embodiment, the wall slits extend obliquely from the inner surface of the ring at an angle of 30° to 90° to the inner tangent of the ring into the transverse plane of the latter down to a depth which is approximately equal to the sound velocity of the gas divided by the product of four times the rotational frequency and the number of blades on the impeller. In this case, the extent of the wall slits in the axial direction is not greater than this depth. It has been found that each of these development contributes to a low surge limit.

In a further embodiment, the ring in the recess is guided in the radial direction by longitudinal ribs arranged on the inside of the casing. The longitudinal ribs, together with the casing inner surface and the ring outer surface, form the passages already mentioned above for creating a pressure balance between the gap and the upstream space in front of the ring. No additional bores in the casing are therefore necessary.

In a further embodiment, the ring is fixed in the axial direction by one or more screws passed through the casing wall. This fastening is simple in terms of design and can be released at any time without problem.

In a further embodiment, the ring is arranged in the recess so as to be displaceable in the axial direction. It is possible by suitable fixing means to fix the ring in several different axial positions. In this way, the extent of the gap in the axial direction, i.e. the gap width, can be varied without new components or extensive modifications being necessary for this purpose. An adjustment of the gap width may be appropriate, for example, in order to adapt the radial compressor to changed operating parameters, for instance temperature and density of the intake air.

BRIEF DESCRIPTION OF THE DRAWINGS

Advantageously exemplary embodiments of the invention are shown in the drawings and described below. In the drawings.

DETAILED DESCRIPTION

Figure 1:
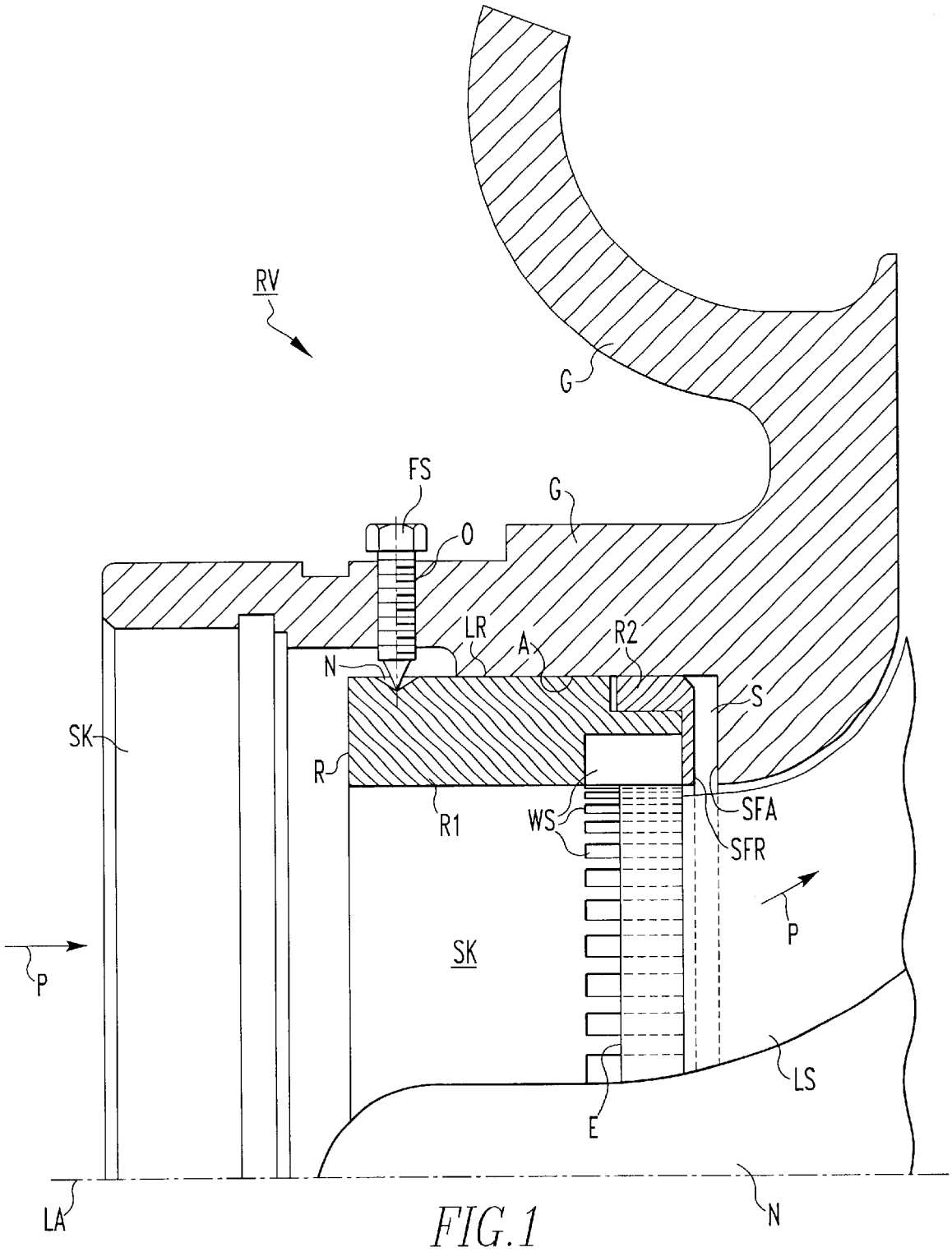
FIG. 1 shows a half longitudinal section through a radial compressor having a ring with wall slits in a simplified representation.

The radial compressor RV shown in FIG. 1 has a casing G, in which an impeller with running axis LA is arranged, the impeller comprising a hub N and moving blades LS fastened thereto. The direction of flow of the gas flowing through a flow duct SK of the compressor RV is indicated by arrows P. On its inner surface pointing towards the flow duct SK, the casing G has a recess A, into which a ring R is inserted concentrically to the running axis LA. For manufacturing reasons, the ring R is composed of two sectional rings R1 and R2. The inner surface of the ring R is provided with a multiplicity of wall slits WS, the configuration of which will be explained further below.

An annular gap S is left between that end face SFR of the ring R which is directed downstream and that end face SFA of the recess A which corresponds thereto and is directed upstream. The width of this gap S, i.e. its extent in the axial direction, has a substantial effect on the surge limit. It has been found that an especially low surge limit can be achieved with a gap width of 1 to 5 per cent of the diameter of the impeller.

In the exemplary embodiment shown in FIG. 1, the axial position of the ring R in the recess A can be fixed by a screw FS. To accommodate the screw FS, a hole O with internal thread is provided in the wall of the casing G. The end of the screw engages in a groove N, which runs around on the outer surface of the ring R. In the exemplary embodiment shown, only one groove N is provided, so that the ring R can be fixed in the recess A only in a single axial position. However, a plurality of parallel grooves may also be provided, so that it is possible to fix the ring in a plurality of axial positions. Grooves may also be completely dispensed with if the point end of the screw FS is harder than the outer surface of the ring R and can thus be pressed into the latter. In the last-mentioned case, the width of the gap S can be established in an infinitely variable manner. It is consequently possible to vary the gap width with very little effort, since it is merely necessary to slacken the screw FS and displace the ring R in the axial direction into the desired position. The screw FS is then tightened again. The ease with which the ring can be fixed in a plurality of axial positions enables the radial compressor to be adapted to changed operating conditions (temperature and density of the intake air, etc.) by varying the gap width. To fix the ring in position, it may be appropriate, instead of only one screw FS, to provide a plurality of screws which are arranged on the casing circumference in a radially symmetrical manner.

The recess A may be made as a bore, so that the entire outer surface of the ring R bears snugly against the inner surface of the recess A. As an alternative, it is possible to provide a plurality of longitudinal ribs LR on the inner surface of the recess, these longitudinal ribs LR extending in the axial direction. Only those ends of the longitudinal ribs LR which point radially inwards then touch the outer surface of the ring R, whereas the remaining portion of the inner surface of the recess is separated from the outer surface of the ring R by a radial gap, which adjoins the axial gap S. This radial gap at the same time serves as a connecting passage between the axial gap and the upstream space in front of the ring. Furthermore, such radial guidance of the ring R by longitudinal ribs LR has the advantage that production tolerances become less noticeable.

As tests have shown, the surge limit is especially low if the ring R is arranged in the flow duct SK in such a way that those ends E of the moving blades LS which are directed upstream lie at a height, preferably approximately centrally, between the axial ends of the wall slits WS and at a distance from the opposite axial ends of the wall slits WSS, which is greater than the width of the wall slits. During rotation of the impeller, those ends E of the moving blades which are directed upstream therefore only sweep partly over the wall slits WS.

Figure 2:
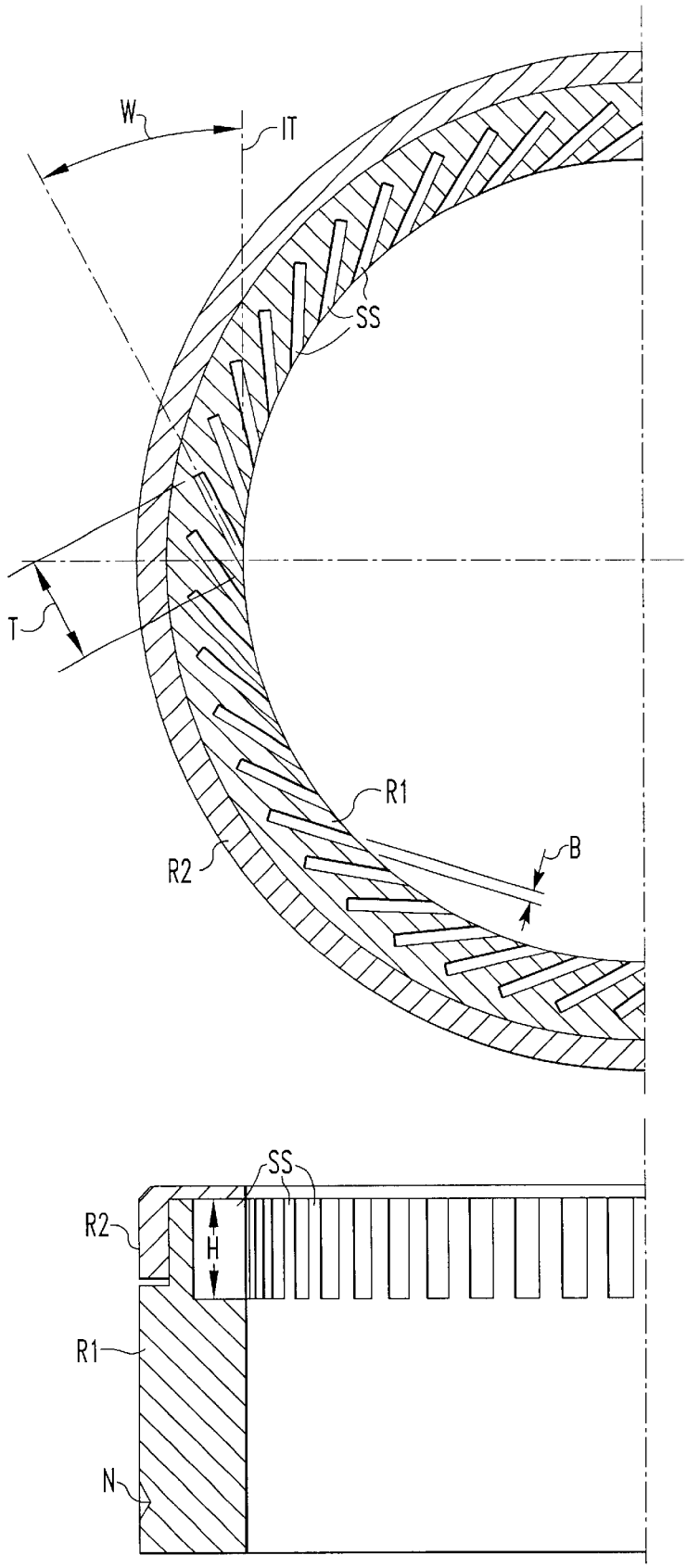
FIG. 2 shows two sections through the ring from FIG. 1 for explaining the geometry of the wall slits.

With reference to FIG. 2, the configuration of the ring R will be explained in more detail below. The ring R essentially comprises the sectional ring R1, which towards its one end face is provided with wall slits WS on its inner surface. The sectional ring R2 is screwed onto this end face like a lid, or is shrunk on or fastened in another manner. The two-piece construction has the advantage that this makes it easier to provide the ring R with wall slits. The wall slits WS extend obliquely from the inner surface of the sectional ring R1 at an angle W to the inner tangent IT of the sectional ring into its wall, specifically in the ring transverse plane parallel to the end face. The definition of the width B, the depth T and the height H of the wall slits WS can be seen from FIG. 2. An especially low surge limit can be achieved if the angle W is between 30° and 90°, the depth T is approximately equal to the sound velocity of the gas to be compressed divided by the product of four times the rotational frequency and the number of moving blades, and in addition the height H of the wall slits is not greater than the depth T.

What is claimed is:

1. A radial compressor for producing a compressed gas flow, comprising:

a casing having an axial inlet and a recess formed in said inlet with an inner surface;

an impeller arranged in the casing for rotation about a rotational axis, coaxial with said axial inlet, the impeller having a hub carrying blades;

a ring received in the recess formed in said inner surface of the casing and arranged concentrically with the hub of the impeller, said ring having wall slits in an inner surface in a region spaced axially from a downstream facing end face of the ring, the wall slits having a width, the downstream facing end face of said ring being disposed in spaced axial relation to an upstream facing wall of the recess so as to form an annular gap therebetween; and the blades of said impeller having upstream facing ends, the upstream facing ends of the blades being disposed in an axial area between opposite axial ends of the wall slits and at a distance from each of the opposed axial ends of the wall slits that is greater than the width of the wall slits.

2. The radial compressor according to claim 1, wherein said impeller has a given diameter and the annular gap has a width, which is 1 to 5 percent of a diameter of the impeller.

3. The radial compressor according to claim 1, wherein the wall slits extend from the inner surface of the ring at an angle of 30° to 90° to an inner tangent into a transverse plane of the ring down to a depth which is approximately equal to a sound velocity of gas flowing through the impeller divided by the product of four times a rotational frequency of the impeller and the number of impeller blades, and the width of the wall slits in the axial direction is not greater than this depth.

4. The radial compressor according to claim 1, wherein a plurality of longitudinal ribs are arranged on the inner surface of the casing within the recess to define a radial gap between the ring and the inner surface of the casing that forms a connecting passage between the annular gap and a space upstream of an upstream face of the ring that is independent of a flow duct defined by the hub of the impeller and the inner surface of the casing.

5. The radial compressor according to claim 1, wherein the ring is fixed within the recess in an axial direction by at least one screw extending through the casing wall and tightened against the ring.

6. The radial compressor according to claim 1, wherein the ring is displaceable in the recess in the axial direction, the ring having fixing means for fixing the ring in at least two different axial positions.

* * * * *